US005873743A

United States Patent [19]

Tkazyik et al.

[11] Patent Number: 5,873,743

[45] Date of Patent: Feb. 23, 1999

[54] HIGH-DENSITY AND HIGH-SPEED CABLE ASSEMBLY

[75] Inventors: William J. Tkazyik, Hyde Park, N.Y.; Ralph A. Papa, Laurys Station, Pa.

[73] Assignees: International Business Machines Corporation, Armonk, N.Y.; Berg Electronics Inc., Etters, Pa.

[21] Appl. No.: 818,211

[22] Filed: Mar. 14, 1997

[51] Int. Cl.[6] ..... H01R 9/09

[52] U.S. Cl. ..... 439/76.1

[58] Field of Search ..... 439/76.1, 59–62, 439/98, 610, 629–32, 74, 79, 77, 497, 493

[56] References Cited

U.S. PATENT DOCUMENTS

| | | | |
|---|---|---|---|
| 2,932,810 | 5/1960 | Novak . | |
| 3,728,667 | 4/1973 | Richelmann . | |
| 3,737,833 | 6/1973 | Jerominek . | |
| 3,794,954 | 2/1974 | Reimer . | |
| 4,679,868 | 7/1987 | Hasircoglu | 439/495 |
| 4,934,943 | 6/1990 | Klein et al. | 439/65 |
| 5,060,113 | 10/1991 | Jacobs | 439/65 |
| 5,108,294 | 4/1992 | Marsh et al. | 439/76 |
| 5,281,150 | 1/1994 | Bundga et al. | 439/67 |
| 5,309,316 | 5/1994 | Yagi et al. | 361/749 |

*Primary Examiner*—Neil Abrams
*Assistant Examiner*—Eugene G. Byrd
*Attorney, Agent, or Firm*—Lawrence D. Cutter

[57] ABSTRACT

Transition printed circuit boards and edge contact wafers are positioned back-to-back and disposed within slots of a diecast aluminum shell with which they are held in place by means of an outer housing. High-speed electrical cable is attached to conductive patterns on the transition printed circuit boards using flux-free methods. The resultant cable and connector are capable of high-speed operation (greater than 100 megahertz) and are still, nonetheless, capable of providing high-density connections to connectors on boards immediately adjacent to semiconductor chips.

6 Claims, 2 Drawing Sheets

HIGH-DENSITY AND HIGH-SPEED CABLE ASSEMBLY

BACKGROUND OF THE INVENTION

The present invention is generally directed to a high-speed and high-density cable connector which is specifically designed for direct connection to a corresponding connector adjacent to a semiconductor chip site on a printed circuit board. Even more particularly, the present invention is directed to a cable connector which employs only a single intermediate element between cabling entering the connector assembly and an edge wafer connector which is designed, positioned and constructed to make contact with a standard printed circuit board connector.

In the design of a simulation engine for large mainframe computer systems, it became clear that some means would have to be provided to make connections directly to connectors which are adjacent to semiconductor chip elements arrayed on a printed circuit board. The simulation engine which was constructed is an exceedingly flexible device capable of a very wide range of emulation functions. However, as is well known, an emulator cannot produce the same real-time operation as the ultimate hardware system which it is designed to emulate. Clearly therefore, it is very important for emulation machines to be run at very high speed. It should be appreciated, therefore, that the speed considerations for emulation machines are, in fact, more rigorous than speed requirements for the end pieces of computer hardware which they are designed to emulate for the purposes of debugging the design. Accordingly, it was determined that cable connections had to be made directly to printed circuit boards at locations immediately adjacent to semiconductor chip sites. However, conventional ribbon cable and connectors are inadequate for this task because of the high-speed requirements (greater than 100 MHz). Accordingly, it became necessary to design a particular connector assembly system which is useful in an emulation machine and, in particular, which is capable of providing direct connections to a printed circuit board at a location adjacent to a chip site. This is in sharp distinction to board edge connectors which do not necessarily have the same rigorous timing constraints in terms of their speed or frequency rating. This is because the connectors of the present invention are meant to connect on the chip-to-chip level rather than the board-to-board level where speed and distance constraints are much less severe.

In the construction of a desired connector assembly, a number of important criteria had to be met. In particular, it was very desirable that cable handling and routing did not significantly alter the electrical characteristics of the cable or the connection. It was important for the connector and for the cabling design that variations in measured impedance were in the range of approximately 10 milliohms. In the design of connector and cabling assemblies, it is also noted that each and every intermediate connection between the cable and the connector is a potential point of degradation. This potential degradation path is further enhanced by the fact that the specific requirements for the emulation system for which a cable design was needed meant that the linear density of connections in terms of lines per inch was quite high. In particular, there was a requirement for 38 signal lines to be accessed at each semiconductor chip edge which was only 32 mm wide. Additionally, the system requirements, which were primarily dictated by the size of the semiconductor chips themselves, meant that the spacing between adjacent signal lines was only 0.025 inches. Thus, the emulation system in question produced extremely tight requirements for cable and connector speed and, concomitantly, severe requirements for signal line spacing.

Small spacing between signal lines produces significant problems in the design of high-speed cabling systems. In particular, the present inventor has appreciated the fact that connection of cable wiring within the connector assembly precludes the utilization of flux-based solders. In particular, it is noted that the spacing requirements are so stringent that the tendency of flux-based solder attachment methods unfortunately results in contamination of the cable dielectric and, furthermore, results in the growth of dendritic material. While dendrite growth is tolerable in certain applications, when the spacing between signal and/or ground conductors is tight, the dendritic growth problem becomes severe. Accordingly, it was necessary to devise a connector and connector assembly approach which simultaneously eliminated all of these problems.

SUMMARY OF THE INVENTION

In accordance with a preferred embodiment of the present invention, a high-density, high-speed cable connector includes a first edge contact wafer which has a plurality of electrical conductors which are arranged in a row and which are positioned for electrical contact with corresponding conductors in a socket which is mounted on a printed circuit board in a position adjacent to a semiconductor chip site on the board. The connector also includes a first transition printed circuit board with conductive patterns thereon extending from a wide end of the board to a narrower end of the transition board. The electrical conductors on or within the edge contact wafer are connected to the electrically conductive patterns on the transition printed circuit board. A second transition printed circuit board and a second edge contact wafer, similar to the first ones, are also employed in a back-to-back configuration and are together disposed in a recess in an end shell which is designed for receiving them and for positioning the electrical contacts on the edge contact wafer in positions which correspond to electrical conductors in a printed circuit board socket. A plurality of shielded cables are provided. The cables have conductors which are affixed to the conductive patterns on the wide ends of the transition boards. These cables are connected via a fluxless connection, typically either by soldering or welding. However, if soldered, no flux is employed. A housing is also provided which surrounds the first and second transition circuit boards and is disposed so as to at least partially surround the end shell in a manner which provides pluggable access to the electrical connectors on the edge contact wafers. The housing naturally has an opening at one end opposite the end shell for passage there-through of the cables. For purposes of the present invention, the cabling employed is 50-ohm high-speed cable which preferably includes two signal lines per cable wherein each signal line is present in a coaxial conductor arrangement. Such a high-speed cable is shown and disclosed in United States patent application serial number [PO9-96-023] which is incorporated herein by reference.

Accordingly, it is an object of the present invention to provide a cable connector for the purposes of providing signal access to a high-density printed circuit board connector disposed adjacent to a chip site.

It is also an object of the present invention to bring information out of a chip site on one printed circuit board for access to another chip site either on the same board or in a closely spaced position on another circuit board.

It is yet another object of the present invention to facilitate the design and construction of logic circuit emulation engines.

It is a still further object of the present invention to provide a cable connector which exhibits extremely close spacing of the signal lines therein.

It is a still further object of the present invention to provide a high-speed cable connector which is meant to attach directly to a corresponding connector on a printed circuit board.

It is a still further object of the present invention to provide a cable connector which is resistant to problems associated with dendritic growth arising from the use of fluxbased solders.

It is a still further object of the present invention to provide a cable connector for connection of individual high-speed cables as opposed to ribbon-based cable connection systems.

It is also an object of the present invention to provide a cable connection assembly in which the electrical properties, primarily impedance and resistance, are constant over time and which also exhibit a very limited degree of variability from one signal line to the next.

It is also an object of the present invention to provide a cable connection assembly which eliminates as far as possible intermediate connections due to the possibility that they might provide pathways for degradation and that they might introduce electrical property variability, particularly variability in impedance.

It is a still further object of the present invention to provide a high-speed cable connector assembly which is manufacturable, as far as possible, using readily available components.

It is also an object of the present invention to provide a cable connection assembly which is readily manufacturable.

Lastly, but not limited hereto, it is an object of the present invention to provide a high-speed, high-density cable connector for direct attachment to a printed circuit board on an area thereof adjacent to chip sites or other components thereon.

DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

FIG. 2 is a top view illustrating a transition printed circuit board employed in the present invention and which also shows the utilization of an edge contact wafer in conjunction with the printed circuit board;

DETAILED DESCRIPTION OF THE INVENTION

Figure 1:
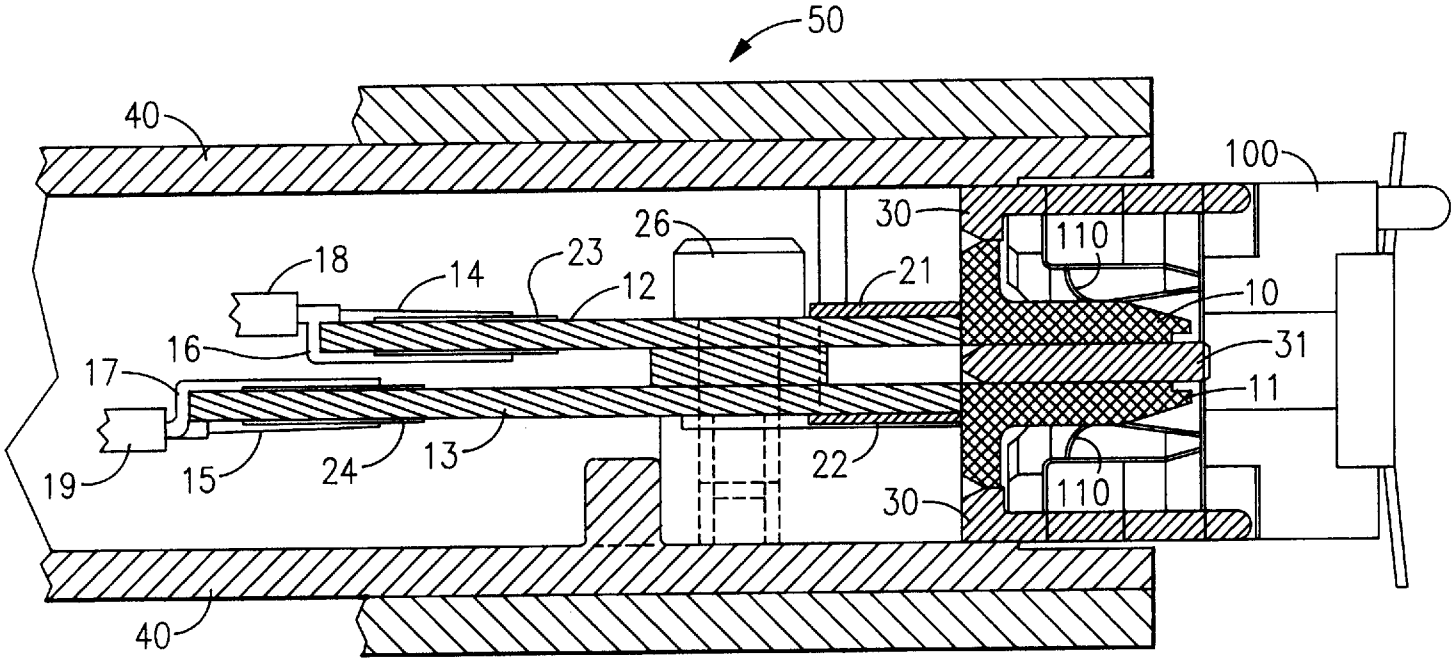
FIG. 1 is a cross-sectional side elevation view illustrating a cable connector assembly in accordance with the present invention.

FIG. 1 illustrates a preferred embodiment of the present invention. In particular, there is shown end shell 30 with center divider 31. This part is an off-the-shelf component. Also seen in FIG. 1 are two transition printed circuit boards 12 and 13 disposed in back-to-back relationship to one another. At one end of transition printed circuit board 12, there is disposed edge contact wafer 10. Edge contact wafer 10 includes electrical conductors 21 which extend therefrom and which are electrically attached to printed circuit board 12. In a similar manner, transition printed circuit board 13 has edge contact wafer 11 attached at one end thereof (in particular, as above, at the narrow end). Edge contact wafer 11 includes electrical conductors 22 which, like conductors 21, are electrically affixed to corresponding transition printed circuit board conductors. It is noted that edge contact wafer 10 is part of an off-the-shelf component, namely, a Berg MicroPax™ assembly. In particular, it is noted that the utilization of readily available off-the-shelf components, such as edge contact wafers 10 and 11 and end shell 30, renders the present invention easy to manufacture and economical to produce. It is, however, noted that the ordinarily designed and intended function of edge contact wafers is for utilization in board level edge connection systems. They are not normally used in connector systems which are meant to attach directly to a site which is adjacent to a semiconductor chip. In fact, the only things that are typically employed as connections adjacent to semiconductor chip devices on a printed circuit board are standard jumper-type connections. However, such jumper connections do not have high-speed cabling requirements.

Figure 2A:
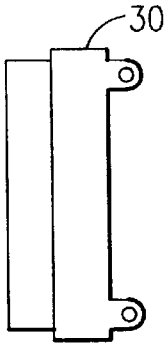
FIG. 2A is a side view of a (preferably die cast) shell which is configured to receive one end of a transition printed circuit board and wafer edge connector.
Figure 2B:
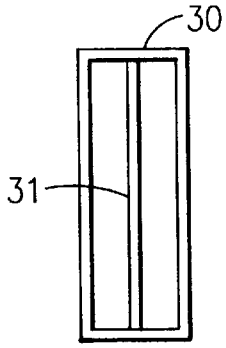
FIG. 2B is an end view of the shell shown in FIG. 2A.

Although not specifically visible in the view shown in FIG. 1, transition printed circuit boards 12 and 13 also include electrically conductive circuit patterns which provide electrical connections between the conductors in edge contact wafers 10 and 11 and cabling conductors 14, 15, 16 and 17. Transition printed circuit boards 12 and 13, however, possess conductive circuit patterns 23 and 24 respectively (see FIG. 2) for ease of connection to the relevant cable lines. Also shown in FIG. 1 is screw 26 which extends through notches 25 in transition printed circuit boards 12 and 13 for this provides a method for affixing the inner portions of the connector assembly to the lower half of housing 40.

An important aspect of the present invention is the attachment of cables 18 and 19 to transition printed circuit boards 12 and 13 respectively. In particular, in each case, the connection of signal conductor 14 and ground conductor 16 (in the case of transition printed circuit board 12) or signal conductor 15 and ground conductor 17 (in the case of transition printed circuit board 13) is done using a fluxless connection. In particular, there are, therefore, two approaches employable for suitable attachment. In particular, conductors 14, 15, 16 and 17 may be welded to circuit land patterns 23 and 24 (see FIG. 3). However, because welding may produce higher temperatures than is otherwise desirable, a preferable method of attachment is the utilization of fluxless solder placed below the conductor during a welding or soldering operation. The presence of flux in the attachment to the printed circuit board is highly deleterious in that it negatively impacts the electrical characteristics of dielectric materials in cables 18 and 19. Furthermore, the use of flux-based solders facilitates dendritic growth between closely spaced land patterns.

Also shown in FIG. 1 is the surface mount female printed circuit board connector into which the male connector of the present invention is plugged. Thus, it is seen that printed circuit board connector 100 includes conductive spring contacts 110 which are in electrical contact with electrical conductors 21 which extend through the body of edge contact wafer 10 or 11.

Figure 3:
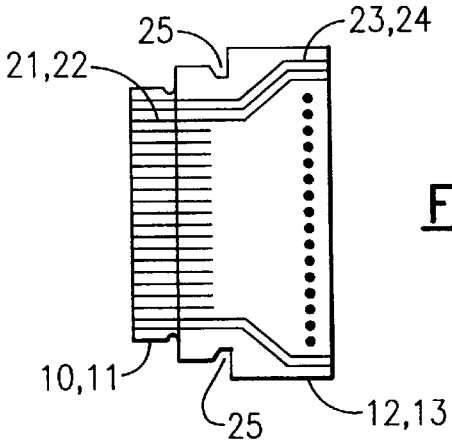
FIG. 3 is a top view of the transition printed circuit board.
Figure 4:
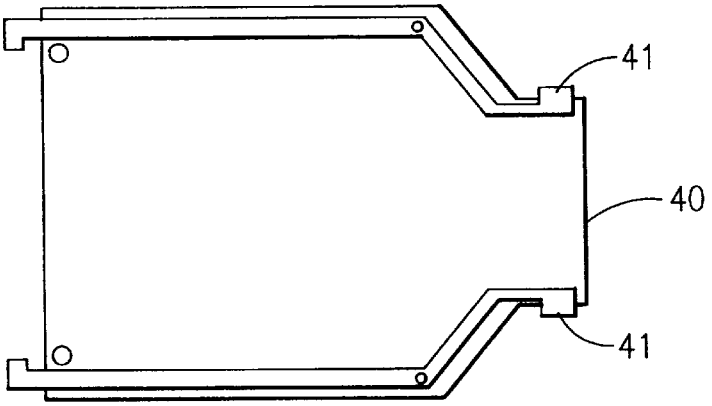
FIG. 4 is a top view of half of a housing unit which is configured to surround the transition printed circuit boards.

FIG. 3 illustrates, in a top view, another view of the relationship between transition printed circuit board 12 or 13 and edge contact wafer 10 or 11. The land patterns on transition printed circuit board 12 or 13 (now visible in this view) are aligned at the narrow end of the board with electrical conductors on or within edge contact wafer 10 or 11. The opposite end of transition printed circuit board 12 or 13 is typically and preferably wider in order to accommodate more readily the attachment of cabling to board 12 or 13.

In constructing the connector of the present invention, transition circuit boards 12 and 13 are inserted, with the cabling already attached, into end shell 30 on either side of divider 31. The desired cabling is preferably attached to selected land patterns 23 and 24, for example, on board 12 or 13 prior to insertion. Screw 26 or any other convenient fastener is disposed through notch 25 in order to affix the assembly to a bottom portion of housing 40. Housing 40 surrounds the transition printed circuit boards and at least partially surrounds shell 30 but, nonetheless, does provide limited access at one end to edge contact wafers 10 and 11 for purposes of electrical contact with a surface mount connector. It is also noted that outer housing 40 also preferably includes pivotable latch levers 41 for better connection to the receiving socket and also as a mechanism for providing easy release.

From the above, it should be appreciated that the present invention fills all of the objectives stated herein. In particular, it is seen that the connector of the present invention provides a spatially and temporally constant and consistent mechanism for cable attachment to a chip site connector. In particular, it is seen that the present invention also provides a connection with few intermediary parts, yet, at the same time, relies upon readily available components.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A connector for attachment of high-speed cable to a printed circuit board socket, said connector comprising:

a first transition printed circuit board having conductive patterns disposed thereon;

a first edge contact wafer having a plurality of conductors disposed in a row and positioned for electrical contact to corresponding conductors in said printed circuit board socket, said first wafer electrical conductors being connected to at least some of said conductive patterns on said first transition printed circuit board;

a second transition printed circuit having conductive patterns disposed thereon;

a second edge contact wafer having a plurality of conductors disposed in a row and positioned for electrical contact to corresponding conductors in said printed circuit board socket, said second wafer electrical conductors being connected to at least some of said conductive patterns on said second transition printed circuit board;

an end shell for receiving first edge contact wafer and also for receiving said second edge contact wafer so as to dispose the electrical conductors of said first and second edge contact wafers in positions corresponding to said electrical conductors in said printed circuit board socket;

a plurality of shielded cables having conductors affixed, via fluxless connection, to said conductive patterns on said transition board; and a housing surrounding said first and second transition printed circuit boards and being disposed at least partially around said shell so as to provide pluggable access to said electrical conductors on said edge contact wafers, said housing having an opening at an end thereof distal from said end shell for passage of said cables.

2. The connector of claim 1 in which said end shell comprises die-cast aluminum material.

3. The connector of claim 1 in which said housing includes a latch connection and release mechanism.

4. The connector of claim 1 in which said first and second transition printed circuit boards are narrower at one end than the other.

5. The connector of claim 1 in which said electrical conductors on said first and second edge contact wafers are spaced apart a distance of at most 0.025 inches.

6. The connector of claim 1 in which said first and second transition printed circuit boards have front sides and back sides and are disposed in a back-to-back relationship.

* * * * *